US006737091B1

(12) United States Patent
Littell, II

(10) Patent No.: US 6,737,091 B1
(45) Date of Patent: May 18, 2004

(54) DISPOSABLE BABY BOTTLE DEVICE

(76) Inventor: Corwin P. Littell, II, P.O. Box 560447, Orlando, FL (US) 32856

( * ) Notice: Subject to any disclaimer, the term of this patent is extended or adjusted under 35 U.S.C. 154(b) by 0 days.

(21) Appl. No.: 10/293,810

(22) Filed: Nov. 14, 2002

(51) Int. Cl.[7] ..... A61J 9/00; A61J 11/04

(52) U.S. Cl. ..... 426/117; 215/11.3; 215/11.6; 215/11.1

(58) Field of Search ..... 215/11.1, 11.3, 215/11.6; 426/117, 115

(56) References Cited

U.S. PATENT DOCUMENTS 2,885,104 A * 5/1959 Greenspan ..... 206/222
3,206,054 A * 9/1965 Militello ..... 215/11.3
3,746,198 A * 7/1973 Howland ..... 215/11.1
3,777,925 A * 12/1973 Eckholm ..... 215/11.3
3,779,413 A * 12/1973 Pickerell et al. ..... 215/11.6
4,558,792 A * 12/1985 Cabernoch et al. ..... 215/11.3
4,623,069 A * 11/1986 White ..... 215/11.1
4,640,424 A * 2/1987 White ..... 215/11.1
4,657,151 A * 4/1987 Cabernoch ..... 215/11.3
4,678,092 A * 7/1987 Rane ..... 215/11.3
4,706,827 A * 11/1987 Cabernoch et al. ..... 215/11.3
4,830,205 A * 5/1989 Hammond et al. ..... 215/11.3
4,895,264 A * 1/1990 Phlaphongphanich ..... 215/11.1
5,429,263 A * 7/1995 Haubenwallner ..... 220/23.91
6,138,847 A * 10/2000 Johnson ..... 215/11.1
6,171,623 B1 * 1/2001 Gaylor et al. ..... 426/117

* cited by examiner

*Primary Examiner*—Sue A. Weaver

(57) ABSTRACT

A disposable baby bottle device for providing pre-packaged liquids for babies. The disposable baby bottle device includes a container having a side wall, an open top, and a plurality of holes being spacedly disposed through the side wall, and also having a lip being disposed along a top edge thereof; and also includes an inner liner being disposed in the container and being leak-proof and sterilized; and further includes a nipple being securely disposed over the open top of the container; and further includes a protective cover being sealingly and removably disposed over the nipple; and also includes a protective cap being removably disposed over the protective cover; and also includes a seal being removably fastened about the protective cap and a portion of the container; and further includes liquids being disposed in the inner liner in the container.

5 Claims, 3 Drawing Sheets

DISPOSABLE BABY BOTTLE DEVICE

BACKGROUND OF THE INVENTION

1. Field of the Invention

The present invention relates to baby bottles and more particularly pertains to a new disposable baby bottle device for providing pre-packaged liquids for babies.

2. Description of the Prior Art

The use of baby bottles is known in the prior art. More specifically, baby bottles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,678,092; U.S. Pat. No. 3,746,198; U.S. Pat. No. 5,579,935; U.S. Pat. No. 3,777,925; U.S. Pat. No. 4,813,556; and U.S. Pat. No. Des. 430,676. While these devices fulfill their respective, particular objectives and requirements, the aforementioned patents do not disclose a new disposable baby bottle device. The prior art includes disposable baby bottles with liners and nipples connected to the containers.

SUMMARY OF THE INVENTION

The general purpose of the present invention, which will be described subsequently in greater detail, is to provide a new disposable baby bottle device which has many of the advantages of the baby bottles mentioned heretofore and many novel features that result in a new disposable baby bottle device which is not anticipated, rendered obvious, suggested, or even implied by any of the prior art baby bottles, either alone or in any combination thereof. The present invention includes a container having a side wall, an open top, and a plurality of holes being spacedly disposed through the side wall, and also having a lip being disposed along a top edge thereof; and also includes an inner liner being disposed in the container and being leak-proof and sterilized; and further includes a nipple being securely disposed over the open top of the container; and further includes a protective cover being sealingly and removably disposed over the nipple; and also includes a protective cap being removably disposed over the protective cover; and also includes a seal being removably fastened about the protective cap and a portion of the container; and further includes liquids being disposed in the inner liner in the container. None of the prior art includes the combination of the elements of the present invention.

There has thus been outlined, rather broadly, the more important features of the disposable baby bottle device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new disposable baby bottle device which has many of the advantages of the baby bottles mentioned heretofore and many novel features that result in a new disposable baby bottle device which is not anticipated, rendered obvious, suggested, or even implied by any of the prior art baby bottles, either alone or in any combination thereof.

Still another object of the present invention is to provide a new disposable baby bottle device for providing pre-packaged liquids for babies.

Still yet another object of the present invention is to provide a new disposable baby bottle device that is easy and convenient to use.

Even still another object of the present invention is to provide a new disposable baby bottle device that ensures that the baby is receiving the necessary nutrients provided in formulas and also eliminates the mess and waste associated with the user attempting to make the liquid formula.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
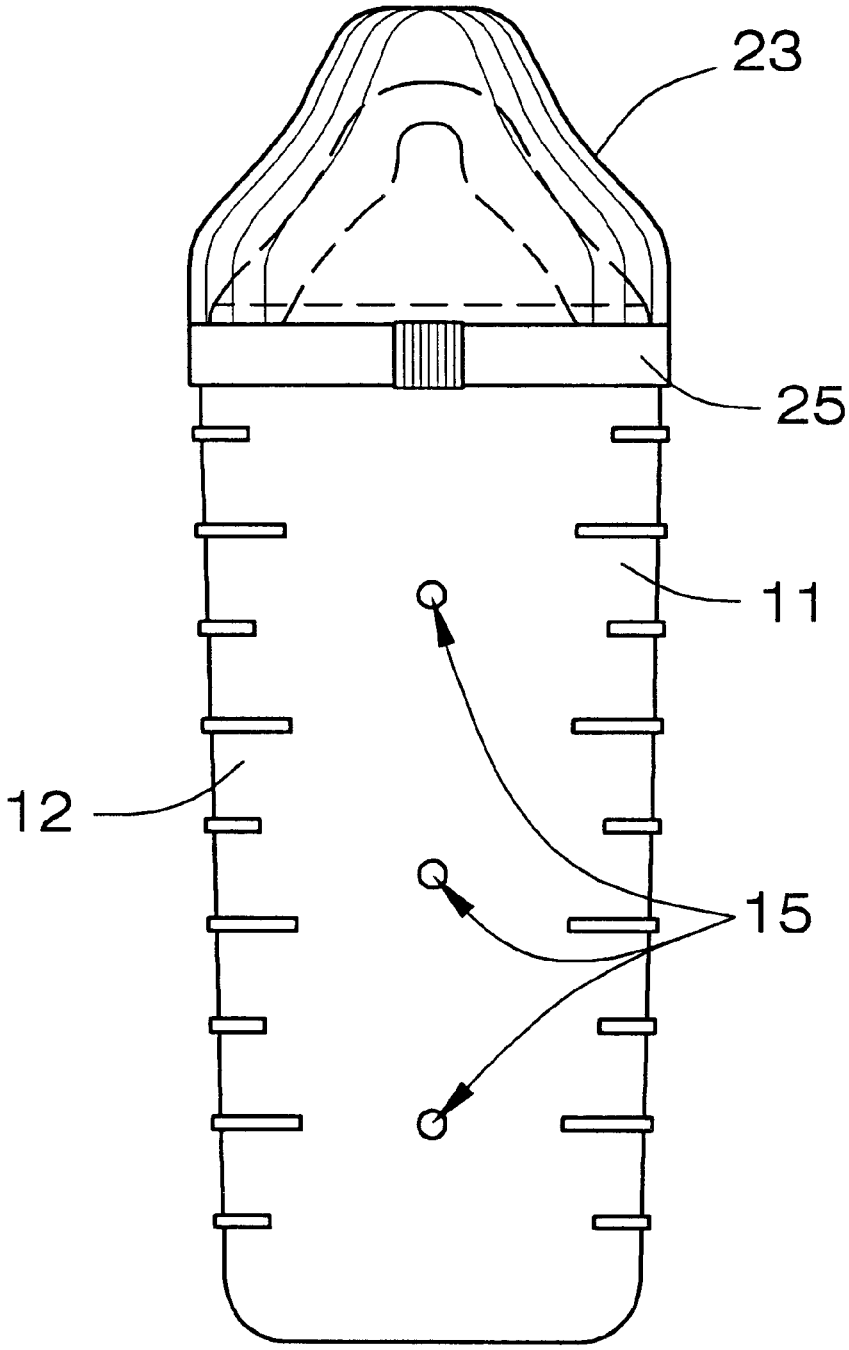
FIG. 1 is a front elevational view of a new disposable baby bottle device according to the present invention.
Figure 2:
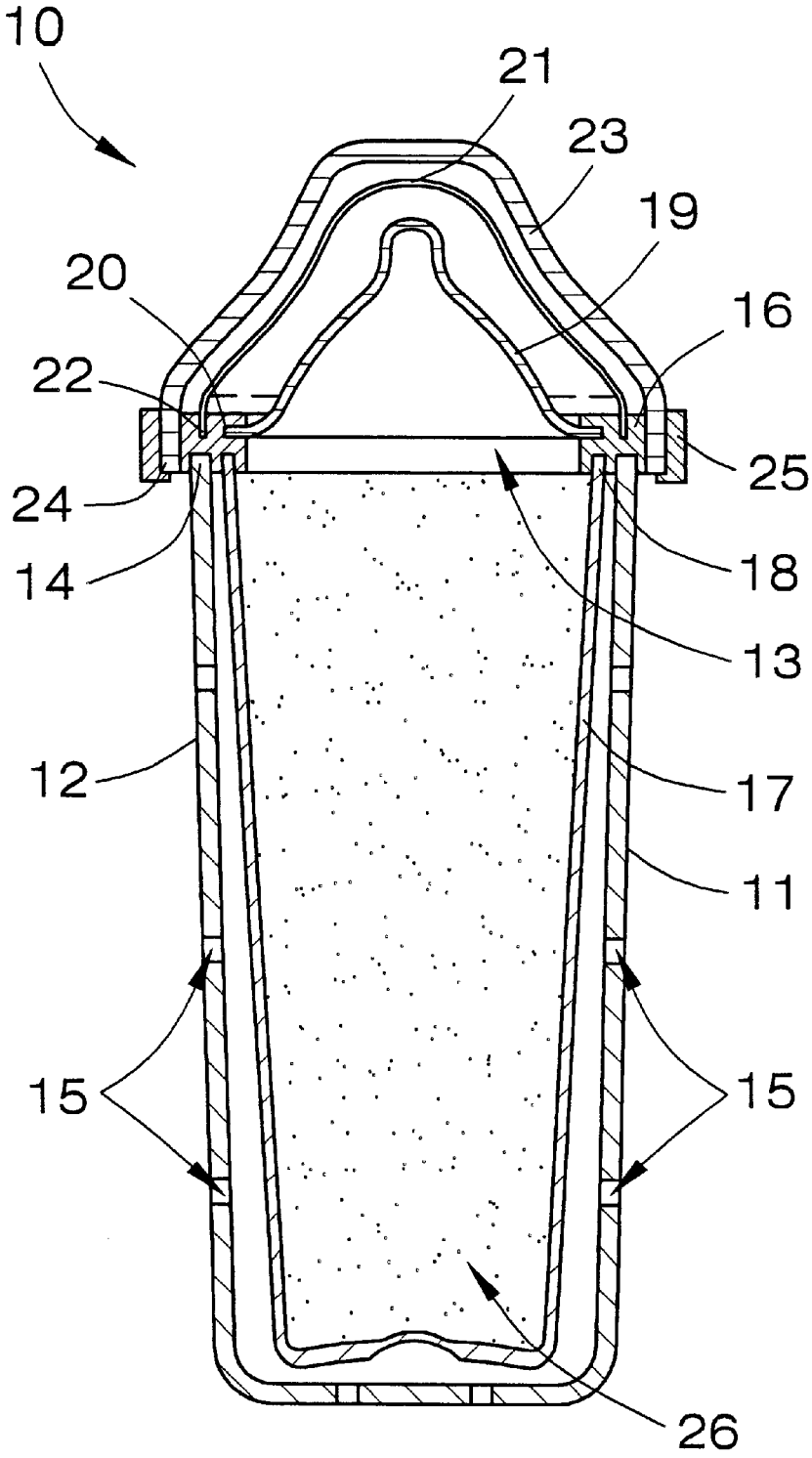
FIG. 2 is a cross-sectional view of the present invention.
Figure 3:
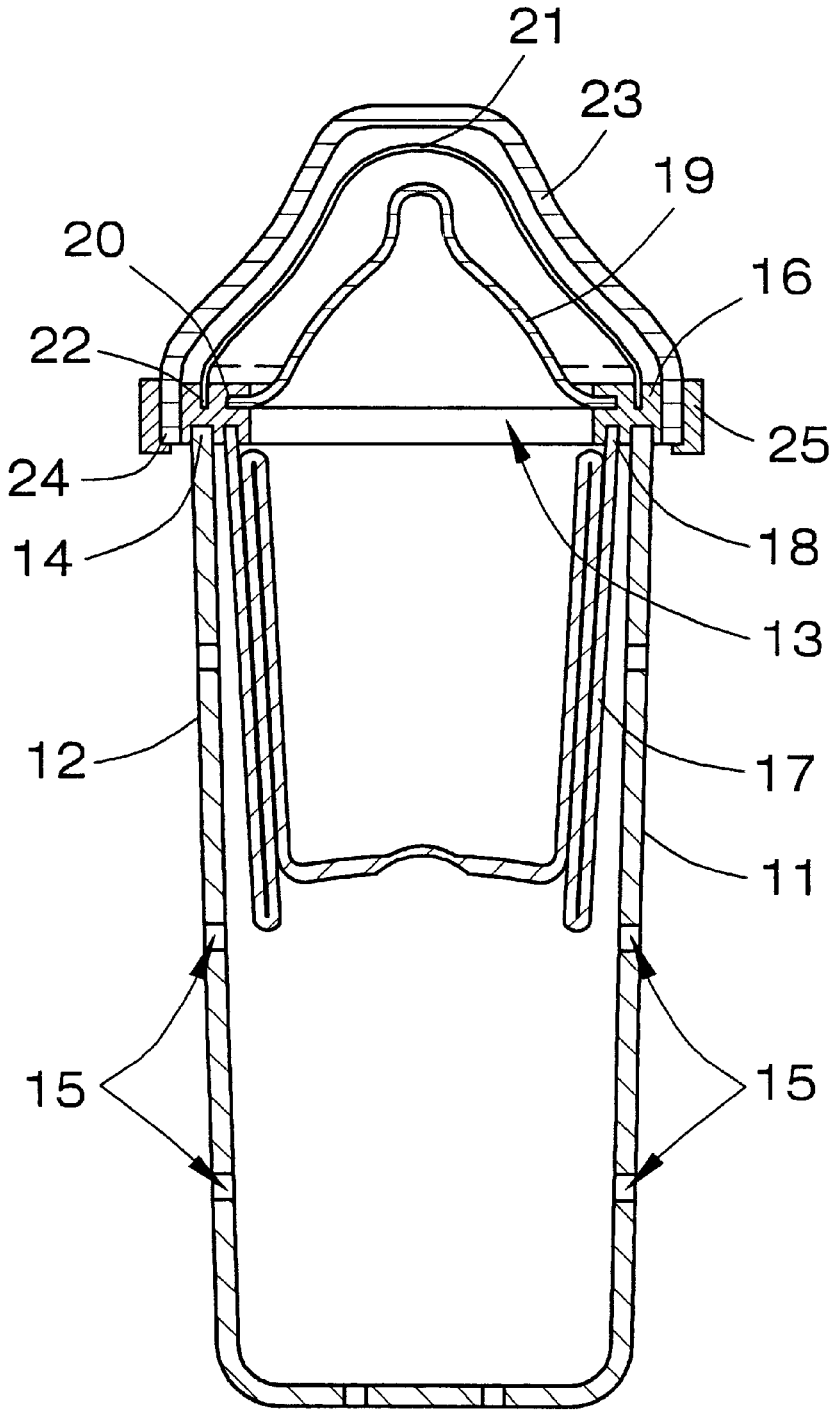
FIG. 3 is another cross-sectional view of the present invention showing the inner liner.

With reference now to the drawings, and in particular to FIGS. 1 through 3 thereof, a new disposable baby bottle device embodying the principles and concepts of the present invention and generally designated by the reference numeral 10 will be described.

As best illustrated in FIGS. 1 through 3, the disposable baby bottle device 10 generally comprises a container 11 having a side wall 12, an open top 13, and a plurality of holes 15 being spacedly disposed through the side wall 12, and also having a lip 16 being conventionally disposed along a top edge 14 thereof. The lip 16 is an annular portion having a definite thickness.

An inner liner 17 is conventionally disposed in the container 11 and is leak-proof and sterilized. The inner liner 17 is a sheet of flexible material being cylindrical-shaped and having a top edge 18 which is securely and conventionally imbedded in a bottom of the lip 16 of the container 11. A nipple 19 is securely and conventionally disposed over the open top 13 of the container 11. The nipple 19 is generally conical-shaped and has an outer edge 20 which is securely and conventionally imbedded in a top of the lip 16 of the container 11.

A protective cover 21 is sealingly and removably disposed over the nipple 19. The protective cover 21 is a peelable strip of material being generally dome-shaped having an outer edge 22 which is securely and conventionally imbedded in the top of the lip 16 of the container 11. A protective cap 23 is removably disposed over the protective cover 21. The protective cap 23 has an outer edge 24 which is removably fastened about the lip 16 of the container 11. A seal 25 is removably fastened about the protective cap 23 and a portion of the container 11. The seal 25 is a strip of material which is removably and conventionally attached about the outer edge 24 of the protective cap 23 and about a portion of the container 11 to sealingly fasten the protective cap 23 to the container 11. Liquid food 26 such as conventional formula is removably contained in the inner liner 17 in the container 11. In use, the user peels off the seal 25 and removes the protective cap 23 and the protective cover 21 from the container 11 to expose the nipple 19 which is sealingly attached to the container 11 to prevent contamination to the liquids 26 contained in the inner liner 17. The baby drinks the liquids 26 from the container 11 with the inner liner 17 as the baby sucks upon the nipple 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the disposable baby bottle device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposable baby bottle device comprising:

a container having a side wall, an open top, and a plurality of holes being spacedly disposed through said side wall, and also having a lip being disposed along a top edge thereof, said lip being an annular portion having a definite thickness;

an inner liner being disposed in said container and being leak-proof and sterilized, said inner liner being a sheet of flexible material being cylindrical-shaped and having an outer edge which is securely imbedded in a bottom of said lip of said container;

a nipple being securely disposed over said open top of said container;

a protective cover being sealingly and removably disposed over said nipple;

a protective cap being removably disposed over said protective cover;

a seal being removably fastened about said protective cap and a portion of said container; and liquids being disposed in said inner liner in said container.

2. A disposable baby bottle device as described in claim 1, wherein said nipple is generally conical-shaped and has an outer edge which is securely imbedded in a top of said lip of said container.

3. A disposable baby bottle device as described in claim 2, wherein said protective cover is a peelable strip of material being generally dome-shaped having an outer edge which is securely imbedded in said top of said lip of said container.

4. A disposable baby bottle device as described in claim 3, wherein said protective cap has an outer edge which is removably disposed about a lip of said container.

5. A disposable baby bottle device as described in claim 4, wherein said seal is a strip of material which is removably attached about said outer edge of said protective cap and about a portion of said container to sealingly fasten said protective cap to said container.

* * * * *